US008192334B2

(12) United States Patent
Sela

(10) Patent No.: US 8,192,334 B2
(45) Date of Patent: Jun. 5, 2012

(54) WEIGHT MACHINE SELECTOR DEVICE

(76) Inventor: Ilan Sela, Petach-Tikva (IL)

( * ) Notice: Subject to any disclaimer, the term of this patent is extended or adjusted under 35 U.S.C. 154(b) by 0 days.

(21) Appl. No.: 12/260,155

(22) Filed: Oct. 29, 2008

(65) Prior Publication Data

US 2010/0105529 A1 Apr. 29, 2010

(51) Int. Cl.
*A63B 21/062* (2006.01)

(52) U.S. Cl. ..... 482/98; 482/99

(58) Field of Classification Search ..... 482/92–94, 482/97–103

See application file for complete search history.

(56) References Cited

U.S. PATENT DOCUMENTS

| | | | | |
|---|---|---|---|---|
| 3,132,861 | A | 5/1964 | Horney | |
| 3,734,495 | A | 5/1973 | Nist et al. | |
| 3,905,599 | A | 9/1975 | Mazman | |
| 4,358,107 | A | 11/1982 | Nissen | |
| 4,546,971 | A | 10/1985 | Raasoch | |
| 4,591,151 | A | 5/1986 | Hensley | |
| 4,610,449 | A * | 9/1986 | Diercks, Jr. | 482/98 |
| 4,623,144 | A | 11/1986 | Rockwell | |
| 4,627,615 | A * | 12/1986 | Nurkowski | 482/98 |
| 4,643,417 | A | 2/1987 | Nieman | |
| 4,648,594 | A * | 3/1987 | Schleffendorf | 482/102 |
| 4,743,018 | A | 5/1988 | Eckler | |
| 4,746,113 | A * | 5/1988 | Kissel | 482/99 |
| 4,763,897 | A | 8/1988 | Yakata | |
| 4,834,365 | A * | 5/1989 | Jones | 482/100 |
| 4,842,271 | A | 6/1989 | Vinciguerra | |
| 4,852,871 | A | 8/1989 | Perko | |
| 4,869,491 | A | 9/1989 | Nolan | |
| 4,973,043 | A | 11/1990 | Nolan | |
| 4,986,538 | A | 1/1991 | Ish, III | |
| 5,037,089 | A * | 8/1991 | Spagnuolo et al. | 482/5 |
| 5,085,430 | A | 2/1992 | Habing | |
| 5,135,451 | A * | 8/1992 | Chen | 482/98 |
| 5,350,344 | A * | 9/1994 | Kissel | 482/98 |
| 5,417,633 | A | 5/1995 | Habing | |
| 5,655,997 | A * | 8/1997 | Greenberg et al. | 482/5 |
| 5,692,997 | A | 12/1997 | Stearns | |

(Continued)

FOREIGN PATENT DOCUMENTS

FR 2613237 A1 * 10/1988

(Continued)

OTHER PUBLICATIONS

International Search Report and the Written Opinion Dated Mar. 23, 2010 From the International Searching Authority Re.: Application No. PCT/IL2009/001013.

(Continued)

*Primary Examiner* — Loan Thanh
*Assistant Examiner* — Victor K Hwang
(74) *Attorney, Agent, or Firm* — The Law Office of Michael E. Kondoudis

(57) ABSTRACT

A weight selector for use with a weight lifting machine having a plurality of weights to be lifted and an exertion element configured to exert force so as to lift a preselected amount of weight comprising: a first selector element configured to mechanically select a first amount of weight to be lifted; a second selector element configured to mechanically select a second amount of weight to be lifted, the second selector element being movable relative to the first selector element; and a distance limiting element configured to limit the distance between the first selector element and the second selector element.

7 Claims, 7 Drawing Sheets

U.S. PATENT DOCUMENTS

| | | | | |
|---|---|---|---|---|
| 5,800,321 | A | 9/1998 | Webber | |
| 5,938,575 | A | 8/1999 | Stearns | |
| 6,106,438 | A | 8/2000 | Dean | |
| 6,183,401 | B1 * | 2/2001 | Krull | 482/98 |
| 6,387,019 | B1 * | 5/2002 | Krull | 482/98 |
| 6,394,937 | B1 | 5/2002 | Voris | |
| 6,491,608 | B1 | 12/2002 | Stearns | |
| 6,558,302 | B2 | 5/2003 | Cluff | |
| 6,692,416 | B1 | 2/2004 | Davis | |
| 6,932,749 | B2 | 8/2005 | Barnes et al. | |
| 7,169,097 | B1 | 1/2007 | Stearns | |
| 7,473,211 | B2 * | 1/2009 | Lee | 482/97 |
| 7,485,076 | B2 * | 2/2009 | Lee | 482/99 |
| 7,841,970 | B2 * | 11/2010 | Striar et al. | 482/93 |
| 2004/0009854 | A1 | 1/2004 | Shiang et al. | |
| 2004/0229737 | A1 | 11/2004 | Stearns | |
| 2007/0149366 | A1 * | 6/2007 | Kuo | 482/98 |

FOREIGN PATENT DOCUMENTS

| | | | |
|---|---|---|---|
| RU | 2188685 | C1 * | 9/2002 |
| WO | WO 2008119140 | A1 * | 10/2008 |

OTHER PUBLICATIONS

Official Action Dated Dec. 28, 2009 From the US Patent anf Trademark Office Re.: U.S. Appl. No. 12/260,155.

Official Action Dated Jun. 25, 2010 From the US Patent and Trademark Office Re.: U.S. Appl. No. 12/435,455.

Response Dated Aug. 25, 2010 to Official Action of Jun. 25, 2010 From the US Patent anf Trademark Office Re.: U.S. Appl. No. 12/435,455.

Official Action Dated Sep. 13, 2010 From the US Patent anf Trademark Office Re.: U.S. Appl. No. 12/435,455.

* cited by examiner

WEIGHT MACHINE SELECTOR DEVICE

FIELD AND BACKGROUND OF THE INVENTION

The present invention, in some embodiments thereof, relates to a device and method for physical conditioning and, more particularly, but not exclusively, to a device and method for physical conditioning by lifting weights.

There are known in the art various weight-lifting machines, wherein a user exerts force on a lever in order to raise a selected number of weights from a stack of weights. U.S. Pat. No. 3,734,495 to Nist et al. discloses a weight training device for exercising the lower limbs, wherein a user's legs exert force on a lever, the lever connected via a cable or chain to a pull bar extending through apertures in a weight stack, in order to raise a selected number of weights from the weight stack. A number of weights to be lifted are selected by inserting a selector pin in an aperture in the weights and in the pull bar. The upper end of the lever is moved "by corresponding movement of the lower end of the lever in the opposite direction," by pushing against the foot pedals, thereby raising the selected number of weights from the stack.

U.S. Pat. No. 3,905,599 to Mazman discloses a weight training device for exercising the arms, wherein a user's arms exert force on a lever, the lever connected via a cable to a weight lift rod extending through apertures in a weight stack, in order to raise a selected number of weights from the stack. The user may select a number of weights to be raised by inserting a selector pin below a stack of weights to be lifted and into an aperture in the weight lift rod. A user may raise a selected number of weights from the stack by exerting an upward force with his arms on handle bars extending from the lever. The device includes a roller on the upper end of the lift rod, such that, "as the lever arm is raised, the roller on the lift rod moves on the lever arm to reduce the user's mechanical advantage and increase his effective load."

U.S. Pat. No. 4,546,971 to Raasoch discloses a weight lifting machine having first and second weight stacks and an assembly of levers and linkages designed to respond to force applied by a user lifting a selected number of weights from the first weight stack. The machine is also provided with a pneumatic cylinder and related linkages which lift a selected number of weights from the second stack, at a selected point in the exercise stroke, without additional force exerted by the user, thereby adding the selected number of weights from the second stack to the selected weights of the first stack.

Additional background art includes various weight lifting machines disclosed in U.S. Pat. No. 4,358,107 to Nissen; U.S. Pat. No. 4,623,144 to Rockwell; U.S. Pat. No. 4,763,897 to Yakata; U.S. Pat. No. 4,842,271 to Vinciguerra; U.S. Pat. No. 4,986,538 to Ish, III; U.S. Pat. Nos. 5,085,430 and 5,417,633 to Habing; U.S. Pat. No. 5,800,321 to Weber; U.S. Pat. Nos. 5,692,997; 5,938,575; 6,491,608; and 7,169,097 and U.S. Patent Application Publication 2004/0229737 to Stearns.

SUMMARY OF THE INVENTION

The present invention, in some embodiments thereof, is a weight machine selector device and method which enables a user to exert force on a lever of a weight lifting machine having a stack of weights, thereby lifting a first number of weights from the stack a particular distance and then, if an additional force is exerted on the lever in the same direction as the first force, the user is able to raise a second, additional weight amount from the stack.

According to an aspect of some embodiments of the present invention there is provided a weight machine selector device for use with a weight lifting machine having a plurality of weights to be lifted and an exertion element configured to exert force so as to lift a preselected amount of weight comprising: a first selector element configured to mechanically select a first amount of weight to be lifted; a second selector element configured to mechanically select a second amount of weight to be lifted, the second selector element being movable relative to the first selector element; and a distance limiting element configured to limit the distance between the first selector element and the second selector element.

According to some embodiments of the invention, the second selector element is slidable, relative to the first selector element along the distance limiting element.

According to some embodiments of the invention, the distance limiting element comprises a plate having a slot therein, the second selector element configured to slide along the slot.

According to some embodiments of the invention, the device comprises a stop element configured to limit the sliding motion of the second selector element relative to the first selector element.

According to some embodiments of the invention, the stop element is adjustable so as to limit the sliding motion of the second selector element to a selected distance from the first selector element.

According to some embodiments of the invention, the distance limiting element is rigid.

According to some embodiments of the invention, the second selector element is configured to be retained in position by turning thereof.

According to some embodiments of the invention, the device comprises markings on the distance limiting element for facilitating positioning of the second selector element.

According to some embodiments of the invention, the device comprises markings on the distance limiting element for facilitating positioning of the adjustable stop element.

According to some embodiments of the invention, the second selector element is provided with a disabling element configured to selectably disable the second selector element.

According to some embodiments of the invention, the distance limiting element is flexible.

According to some embodiments of the invention, at least a portion of the distance limiting element is disposed within the second selector element.

According to some embodiments of the invention, the second selector element is movable relative to the first selector element by lengthening or shortening of the distance limiting element.

According to some embodiments of the invention, the distance limiting element is configured to be lengthened or shortened by turning of the second selector element.

According to some embodiments of the invention, the distance limiting element is elastic.

According to some embodiments of the invention, the device further comprises a hanging element configured to retain the device proximal to a user.

According to some embodiments of the invention, the device further comprises: a third selector element configured to select a third weight amount to be lifted; and a second distance limiting element configured limit the distance between the third selector element and the first selector element.

According to some embodiments of the invention, the plurality of weights to be lifted comprises a stack of weights, the first selector element configured to select a first number of weights to be lifted from the stack, and the second selector element configured to select a second number of weights to be lifted from the stack.

According to an aspect of some embodiments of the present invention there is provided a plurality of weight selectors for use with a weight lifting machine having a plurality of weights to be lifted and an exertion element configured to exert force so as to lift a preselected amount of weight, each of the plurality of weight selectors comprising: a first selector element configured to mechanically select a first weight amount to be lifted; a second selector element configured to mechanically select a second weight amount to be lifted; wherein the distance between the first selector element and the second selector element is fixed.

According to an aspect of some embodiments of the present invention there is provided a method of weight lifting comprising: selecting a first weight amount to be lifted on exertion of a first force; selecting a second weight amount to be lifted on exertion of a second force, the second force greater than the first force; limiting the distance over which the first force is to be exerted before the second force is exerted; exerting the first force such that the first weight amount is lifted; and exerting the second force such that the second weight amount is lifted.

According to some embodiments of the invention, the first force is exerted on the first weight amount so as to lift the first weight amount a particular distance before the second force is exerted on the second weight amount; wherein the first and second forces are exerted in the same direction.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF EMBODIMENTS OF THE INVENTION

Figure 1A:
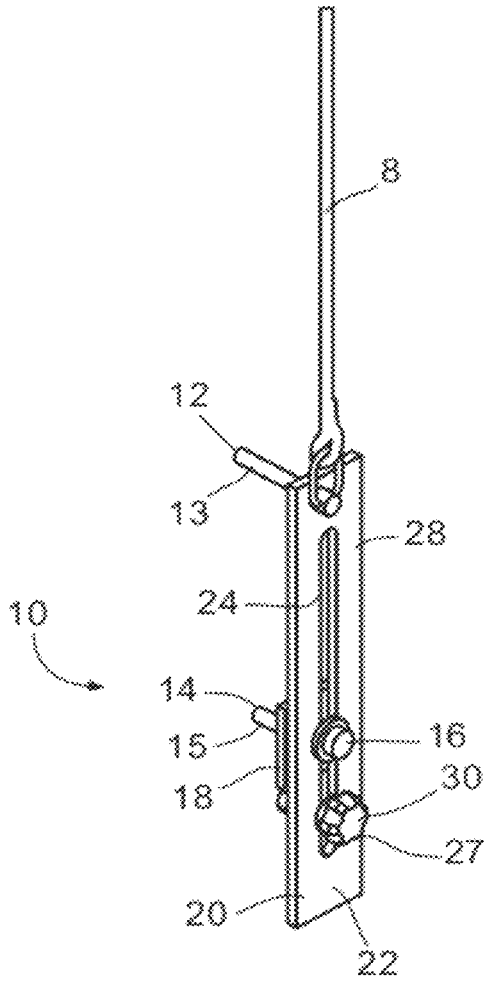
FIGS. 1*a* and 2 are front and rear perspective views, respectively, of a weight selector device in accordance with an embodiment of the present invention.

The present invention, in some embodiments thereof, relates to a device and method for physical conditioning and, more particularly, but not exclusively, to a device and method for physical conditioning by lifting weights.

An embodiment of the present invention is a weight machine selector device for use with a weight lifting machine having a vertical stack of weights. The device enables a user to select first and second amounts of weight to be lifted from the weight stack and to select a distance through which the muscle(s) being used to raise the first weight amount must be exerted before the second selected amount of weight is to be lifted. The device of the present invention, in some embodiments, enables the user to exert a first force on a lever of the weight lifting machine, thereby lifting the first selected amount of weight from the stack and then, once the first force has been exerted over the selected distance, the additional force must be exerted on the lever in the same direction as the first force, to lift the second selected weight amount from the stack.

Before explaining at least one embodiment of the invention in detail, it is to be understood that the invention is not necessarily limited in its application to the details of construction and the arrangement of the components and/or methods set forth in the following description and/or illustrated in the drawings and/or the examples. The invention is capable of other embodiments or of being practiced or carried out in various ways.

Figure 2:
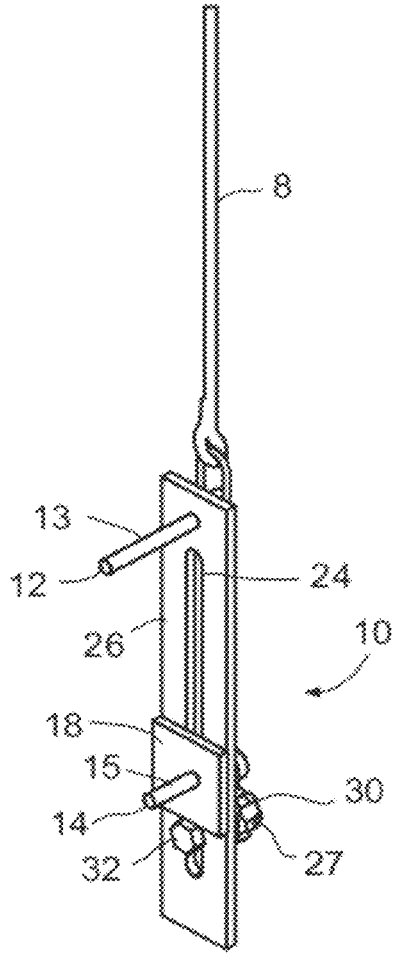

Referring now to the drawings, FIGS. 1*a* and 2 illustrate a weight selector device 10 according to an embodiment of the present invention. Weight selector device 10 includes first and second selector elements 12 and 14 and a distance limiting element 20 for limiting the maximum distance between selector elements 12 and 14. Distance limiting element 20 is provided with a stop element 27, which will be discussed further below, for limiting the distance between second selector element 14 and the first selector element 12.

In the embodiment shown, distance limiting element 20 is constructed as a rigid rectangular plate 22 having a front surface 28 and a rear surface 26 and having a slot 24 formed therein. Selector elements 12 and 14 are utilized for selecting a desired number of weights to be lifted from the stack. It should be noted that, while the length of selector element 12 is substantially similar to that of a selector pin used in a conventional weight lifting machine, the length of selector element 14 is significantly shorter than that of selector element 12, as will be discussed below.

Weight selector device 10 is constructed of a rigid material, such as any suitable metal or plastic. In some embodiments, distance limiting element 20 may be constructed of a flexible material. Selector elements 12 and 14 are configured as cylindrical pegs 13 and 15, respectively, each having a diameter substantially identical to that of a selector pin used in a conventional weight lifting machine having a stack of weights.

In the embodiment shown, weight selector device 10 is constructed such that first selector element 12 is disposed at a fixed point near the top of plate 22 and protrudes from the rear surface 26 of distance limiting element. First selector element 12 may protrude from the front surface 28 of distance limiting element 20, although such protrusion is not necessary. Second selector element 14 is constructed such that it passes through slot 24 and is slidable therein, thereby enabling second selector element 14 to be moved toward and away from first selector element 12. Second selector element 14 is provided with a retaining element 16, at the front surface 24 of distance limiting element 20, and a retaining element 18, at the rear surface 26 of distance limiting element 20, such that second selector element 14 is retained within slot 22 and is maintained at an orientation of 90 degrees relative to distance limiting element 20. In the embodiment shown, retaining element 16 is constructed as a circular head and washer assembly on the end of second selector element 14 located at the front surface 28 of distance limiting element 20, and retaining element 18 is constructed as a square plate in which second selector element 14 is fixed or fastened at the rear surface 26 of distance limiting element 20. Optionally, any suitable means for similarly retaining second selector element 14 within slot 24 may be used.

In the embodiment shown, stop element 27 limits the sliding motion of second selector element 14 relative to first selector element 12. In the embodiment shown, stop element 27 is constructed as a peg which is slidable along slot 24. In the embodiment shown, stop element 27 includes an adjustment knob 30, the function of which will be discussed below, at the front surface 28 of distance limiting element 20, and includes an enlarged head 32, at the rear surface 26 of distance limiting element 20, such that stop element 27 is slidably retained within slot 24. The stop element may be positioned at any selected location along slot 24, below second selector element 14, and may be fixed at the selected location by turning of the adjustment knob 30. As shown in FIG. 1*a* second selector element 14 and stop element 27 are disposed within slot 24, such that second selector element 14 is positioned between stop element 27 and first selector element 12, in order that stop element 27 may limit the sliding motion of second selector element 14 to a selected distance from first selector element 12. Alternatively, if desired, any suitable mechanism for limiting the distance between first and second selector elements may be employed such as, for example, an adjustable cable connected therebetween.

Device 10 may be provided with a hanging element 8 which may be fastened at a first end thereto by any suitable means. Hanging element 8 may be fastened at a second end, for example, to a frame (not shown) of a weight lifting machine with which device 10 is to be employed, such that device 10 hangs therefrom, thereby maintaining device 10 adjacent a weight stack of the weight lifting machine, proximal to a user.

As known in the art, when it is desired to lift a certain number of weights from a stack of weights of a conventional weight lifting machine, a user inserts a selector pin into a selector bar, below the selected number of weights to be lifted, such that, when he exerts force on a lever, the weights located above the selector pin are raised. As the user continues to exert force on the lever, the weights are raised further, and remain raised until the user reduces his force on the lever, thereby lowering the weights. In contrast, the device according to embodiments of the present invention enables a user to exert a first force on a lever of the weight lifting machine, thereby lifting a first selected number of weights a particular distance and then, if a second force is exerted on the lever in the same direction as the first force, the user is able to raise a second selected weight amount from the weight stack.

With additional reference to FIGS. 3 through 4*d*, a method in accordance with an embodiment of the present invention will be discussed. Stop element 27 is positioned at a selected location along slot 24 and adjustment knob is turned, thereby fixing the position of stop element 27 along distance limiting element 20. As will be discussed below, the position of stop element 27 relative to first selector element 12 will determine the distance over which a first force is to be exerted, in order to raise a first selected weight amount, before a second force must be exerted, in order to raise a second selected weight amount. Device 10 is then moved adjacent to a weight stack 42, such as that of a conventional weight lifting machine 40. Since first selector element 12 is longer than second selector element 14, as noted above, first selector element 12 is first inserted into a space between adjacent weights, under a first selected weight amount to be lifted. As shown in FIG. 4*a*, by way of example only, first selector element 12 may be inserted in the space between weights 44 and 46. Then, as device 10 is moved closer to weight stack 42, second selector element 14 is moved along slot 24 such that second selector element 14 positioned in the space under a second selected weight amount to be lifted. In the example shown in FIG. 4*a*, second selector element 14 is inserted into the space between weights 52 and 54 and, simultaneously, first selector element 12 is inserted into a hole (not shown) in selector bar 59, the hole disposed at a location between weights 44 and 46. The position of device 10 relative to weight lifting machine 40, prior to lifting of weights, is shown in FIG. 4*a*.

Figure 4D:
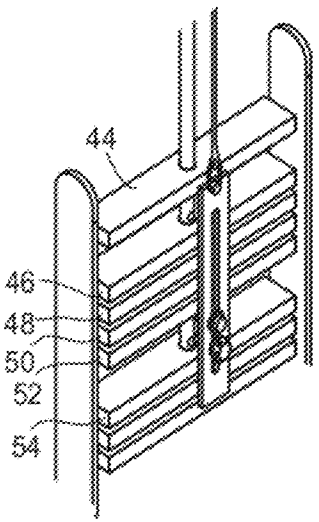
FIG. 4*d* is a perspective view of the weight selector device adjacent the weight stack of FIG. 4*c*, wherein a second weight amount is lifted, in accordance with an embodiment of the present invention.
Figure 4C:
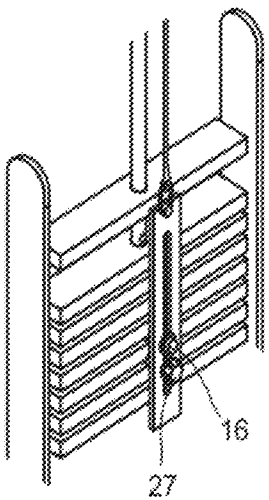
FIG. 4*c* is a perspective view of the weight selector device adjacent the weight stack of FIG. 4*b*, wherein the distance through which the first weight amount must be lifted before a second weight amount is to be lifted has been reached, in accordance with an embodiment of the present invention.
Figure 4B:
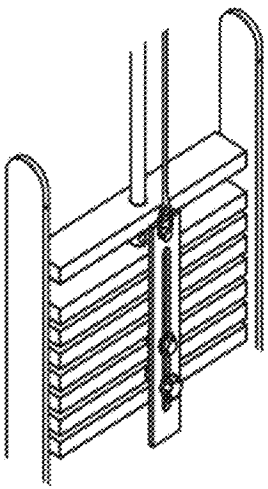
FIG. 4*b* is a perspective view of the weight selector device adjacent the weight stack of FIG. 4*a*, wherein a first weight amount is lifted, in accordance with an embodiment of the present invention.

As shown in FIG. 4*b*, when a first force sufficient to lift weight 44 is exerted on, for example, a lever (not shown) of weight lifting machine 40, selector bar 59 and first selector element 12, positioned within a hole in selector bar 59, are raised, thereby raising the first weight amount which, in the example shown, is weight 44. As first selector element 12 is raised, distance limiting element 20 is raised therewith. As distance limiting element 20 is raised, second selector element 14 slides along slot 24, toward stop element 27. As continued force is exerted on the lever and weight 44 is raised further, as shown in FIG. 4*c*, and second selector element 14 continues to slide along slot 24 toward stop element 27, until it contacts stop element 27. Once second selector element 14 contacts stop element 27, a second force sufficient to raise the second weight amount must be exerted on the lever. As the second force is exerted, the selector bar 59 is raised further, and second selector element 14, positioned below the second weight amount, contacts weight 52, allowing the second weight amount to be raised. As in the example shown in FIG. 4*d*, the second force is sufficient to raise weights 46, 48, 50, and 52.

Figure 3:
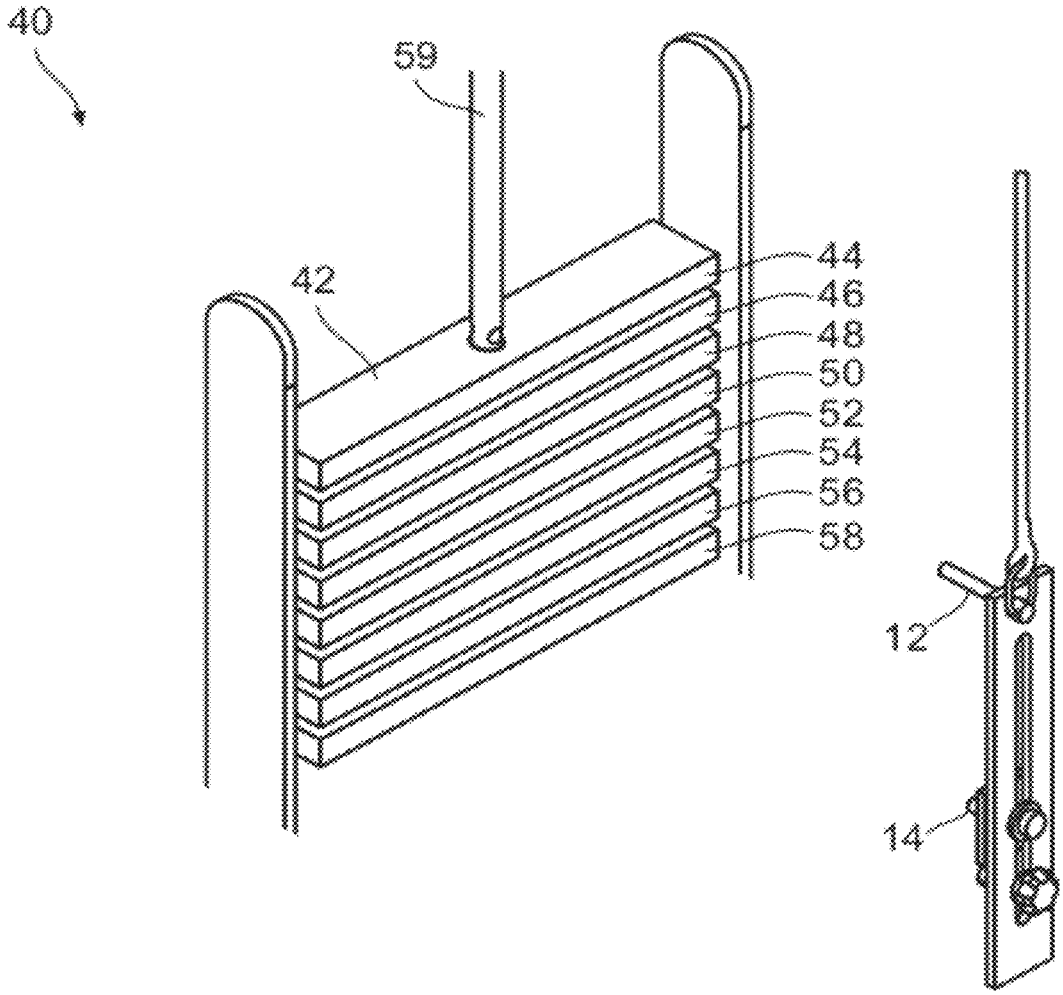
FIG. 3 is a perspective view of a the weight selector device of F*igs*. 1*a* and 2, adjacent a weight stack and selector bar of a conventional weight lifting machine having a weight stack.
Figure 4A:
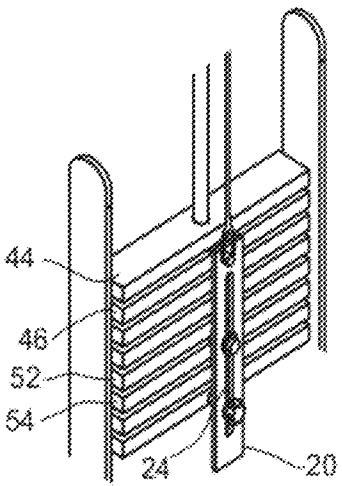
FIG. 4*a* is a perspective view of the weight selector device of FIGS. 1*a*-3 adjacent a weight stack of a conventional weight lifting machine, shown prior to lifting of weights from the weight stack, in accordance with an embodiment of the present invention.

It may be noted that FIGS. 3-4 illustrate an example wherein one weight from the weight stack is selected for the first weight amount to be lifted, four weights from the weight stack are selected for the second weight amount to be lifted, and the stop element is fixed at a particular location along slot 24 such that a particular distance was selected, over which the first force is to be exerted before the second force. It should, however, be noted that, if desired, any number of weights may be selected for each of the first and second weight amounts, and any selected distance over which the first force is to be exerted before the second force is exerted may be selected, taking into consideration the following limitations: the number of weights provided by the weight lifting machine and the length of slot 24 in distance limiting element 20. Preferably, the first and second weight amounts and the distance over which the first force is to be exerted before the second force is exerted should all be selected according to an exercise plan, preferably determined by an exercise specialist.

Figure 5A:
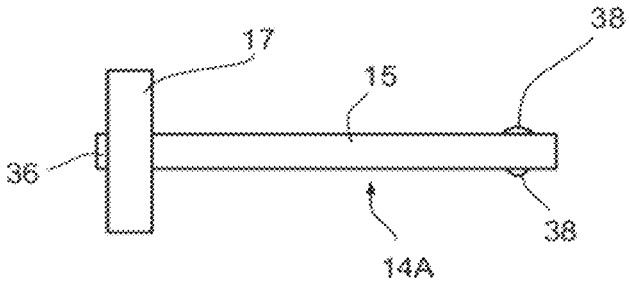
FIGS. 5*a* and 5*b* are side views of embodiments of a second selector element in accordance with an embodiment of the present invention.

FIG. 5*a* illustrates a second selector element 14*a* in accordance with an alternative embodiment of the present invention. Second selector element 14*a* may be inserted in slot 24 of device 10, in place of second selector element 14 (FIG. 1*a*). In contrast to second selector element 14, it may be noted that second selector element 14*a* includes a retaining element 17, to be positioned at the front surface 28 of distance limiting element 20, and that second selector element 14*a* does not require a retaining element 18, at the rear surface 26 of distance limiting element 20, as does second selector element 14. Retaining element 17 is provided with a button 36 and the end of peg 15 is provided with a pair of rounded protrusions 38 which are retractable into the interior of peg 15 upon pressing of button 36. Protrusions may be spring-loaded, if desired. When it is desired to insert second selector element 14*a* in the space between weights of weight stack, button 36 is pressed, such that protrusions 38 are retracted into peg 15. Once second selector element 14*a* has been inserted sufficiently into the space between weights, the protrusions are expelled from peg 15, thereby maintaining second selector element 14*a* in its position in the weight stack. When it is desired to remove second selector element 14*a* from the weight stack, button 36 is again pressed, thereby retracting protrusions 38, such that second selector element 14*a* may be removed from the weight stack.

Figure 5B:
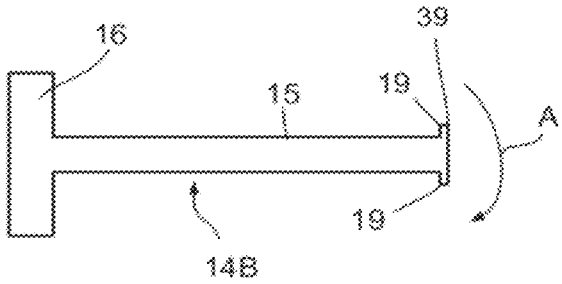

FIG. 5*b* illustrates a second selector element 14*b* in accordance with an embodiment of the present invention. Second selector element 14*a* may be inserted in slot 24 of device 10, in place of second selector element 14 (FIG. 1). In contrast to second selector element 14, it may be noted that second selector element 14*b* includes a retaining element 39 having a pair of protrusions 19, which are to be disposed adjacent the rear surface 26 of distance limiting element 20. When it is desired to insert second selector element 14*b* in the space between weights of a weight stack, retaining element 16 is rotated in the direction of arrow A, until protrusions 19 are positioned horizontally, on either side of peg 15, thereby enabling second selector element 14*b* to be inserted into the space between adjacent weights of the weight stack. Once second selector element 14*b* has been inserted sufficiently into the space between weights, retaining element 16 is rotated 90 degrees in the direction of arrow A, such that protrusions 19 are positioned vertically, on either side of peg 15, thereby preventing second selector element 14*b* from being removed from the weight stack. When it is desired to remove second selector element 14*b* from the weight stack, retaining element 16 is again rotated 90 degrees in the direction of arrow A, such that protrusions 39 are positioned horizontally, on either side of peg 15, thereby enabling second selector element 14*b* to be removed from the weight stack.

Figure 6:
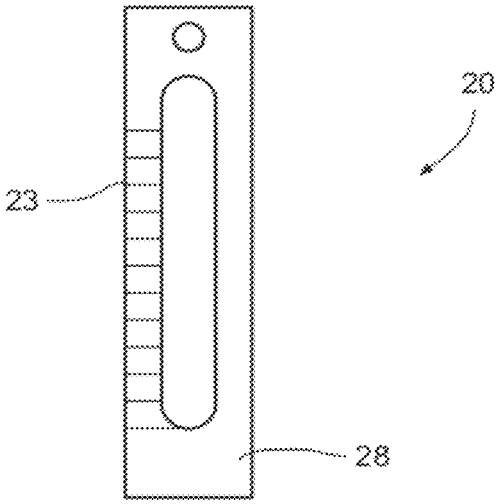
FIG. 6 is a front view of a distance limiting element having markings thereon, in accordance with an embodiment of the present invention.

FIG. 6 illustrates a distance limiting element 20, on the front surface 28 of which there is provided a series of markings 23. Markings 23 may serve as a guide, for example, to facilitate positioning of second selector element 14 (FIG. 1) in a weight stack, thereby enabling selection of a second weight amount to be lifted. Additionally or alternatively, markings 23 may serve as a guide, for example, to facilitate positioning of stop element 27, thereby enabling selection of the distance over which a first force is to be exerted, in order to raise a first selected weight amount, before a second force is exerted, in order to raise a second selected weight amount. For example, each of markings 23 may indicate a weight amount, for positioning of second selector element 14, or a distance amount, for positioning of stop element 27. Optionally, there may be provided a chart indicating weight amounts to be selected and/or distance amounts to be selected, in order to achieve specific weight training effects.

If it is desired to lift only one weight amount from the stack of weights, the present embodiment may be employed by disabling second selector element 14, such that only first selector element 12 is operational. In order to disable second selector element 14, device 10 (FIG. 1*a*) may be provided with, for example, a spring loaded disabling mechanism 6 (FIG. 1*b*) which may selectably disable selector element 14.

Figure 1B:
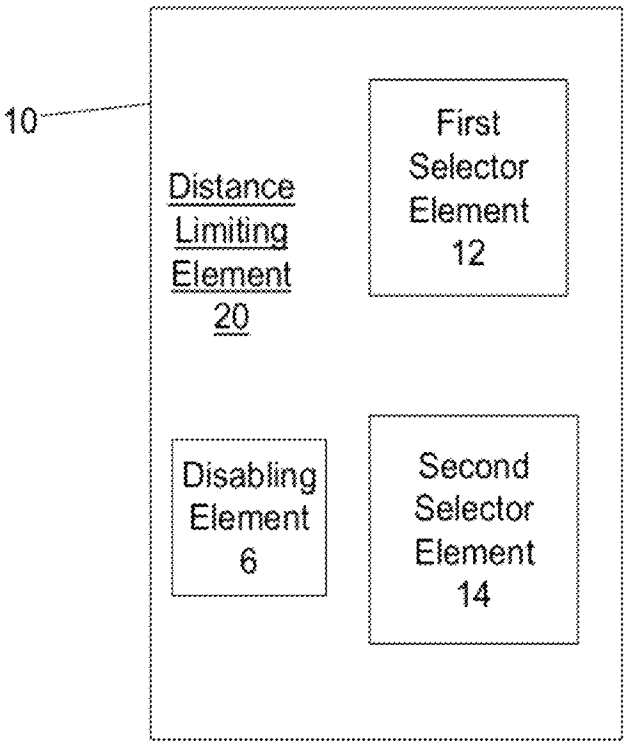
FIG. 1*b* illustrates schematically the relationship among some components of weight selector device 10 in accordance with an embodiment of the invention.

FIG. 1*b* is a schematic box diagram of weight selector device 10 shown in Figs. l*a* and 2, including first and second selector elements 12 and 14, distance limiting element 20, and disabling element 6, as discussed above.

Figure 7A:
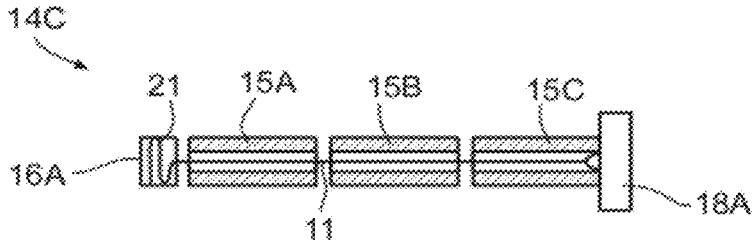
FIGS. 7*a* and 7*b* are side views of a combined second selector element and distance limiting element, in accordance with an embodiment of the present invention.
Figure 7B:
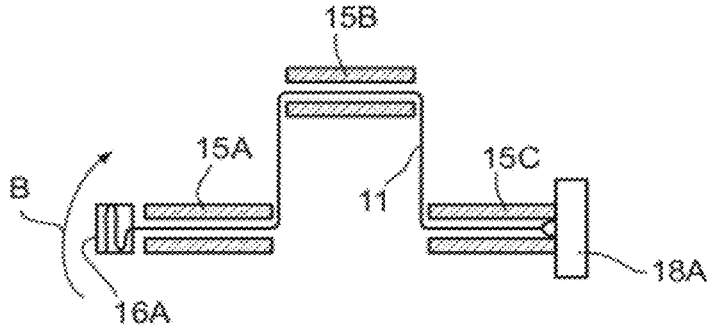
Figure 7C:
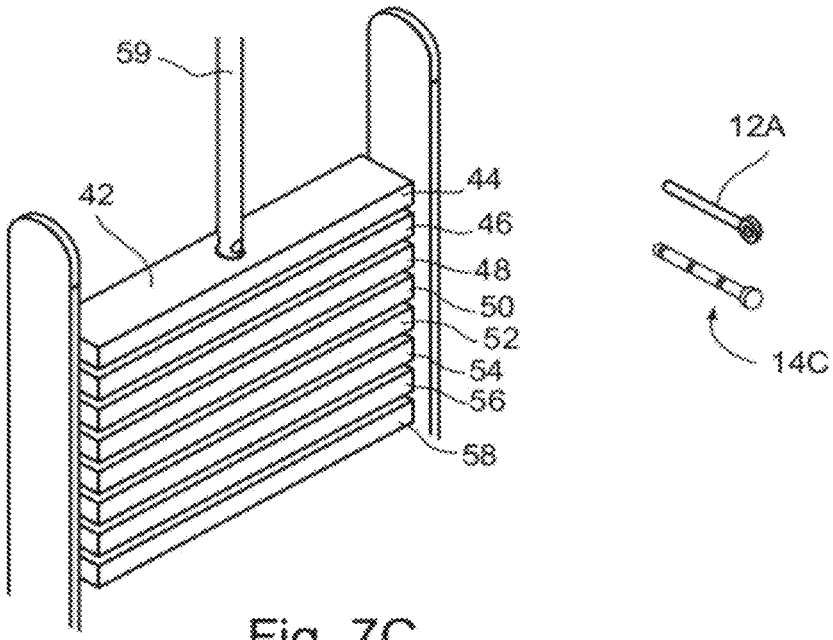
FIG. 7*c* is a perspective view of a conventional weight lifting machine having a weight stack and first selector element, wherein the combined second selector element and distance limiting element shown in FIG. 7*a* is utilized.

FIGS. 7*a* and 7*b* illustrate an alternative embodiment of the invention, for use with a selector pin 12*a* of a conventional weight lifting machine having a stack of weights to be lifted, as shown in FIG. 7*c*. In accordance with this embodiment, a second selector element 14*c* is operable to replace second selector element 14 and distance limiting element 20 shown in FIG. 1*a*. Second selector element 14*c* is formed of three peg portions 15*a*, 15*b*, and 15*c* having a distance limiting element in the form of a flexible cable 11 extending therethrough. Peg portion 15*a* may be provided at a first end with a rotatable adjustment element 16*a* and at a second end with a stationary retaining element 18*a*. Cable 11 is longer than the total length of peg portions 15*a*, 15*b*, and 15*c*. A first end of cable 11 may be fastened to retaining element 18*a*, within device 14*c*, by any suitable means. A second end of cable 11 is fastened to adjustment element 16*a*, within device 14*c*, and the excess length 21 of cable 11 is wound around adjustment element 16*a*, such that the portion of cable 11 disposed within peg portions 15*a*, 15*b*, and 15*c* may be lengthened as desired, by rotating adjustment element 16*a* in the direction of arrow B. Alternatively, if desired, device 14*c* may be provided with a spool (not shown) within device 14*c*, such that the excess length 21 of cable 11 may be wound therearound. Optionally, the mechanism by which the excess length 21 of cable 11 is retained may be spring-loaded. When in use, the second selector element 14*c* is movable relative to the first selector element (FIG. 7*c*) by lengthening or shortening of the cable 11.

When it is desired to select a first weight amount to be lifted, selector pin 12*a* is inserted into a space under a first weight in a weight stack and is further inserted into a hole in a selector bar 59, as discussed above.

In order to select a distance over which a first force is to be exerted, in order to raise the first selected weight amount, before a second force is exerted, in order to raise a second selected weight amount, adjustment element 16*a* may be rotated in the direction of arrow B, thereby releasing from the spool a certain amount of cable within second selector element 14*c*. Adjustment element 16*a* may be provided with markings (not shown) which indicate the degree of rotation necessary for releasing a particular amount of cable within second selector element 14*c*, thereby facilitating selection of the distance over which a first force is to be exerted, in order to raise the first selected weight amount, before a second force is exerted, in order to raise the second selected weight amount. Alternatively, if desired, second selector element 14*c* may be provided with a mechanism (not shown) for selecting the amount of cable released within the second selector element, wherein rotation of a portion of the device is not required. Such a mechanism may, for example, be moved in and out, or up and down.

In order to select a second weight amount to be lifted, second selector element 14*c* is positioned under a second weight amount in the weight stack by first inserting adjustment element 16*a* and peg portion 15*a* and by then further inserting second selector element 14*c* into the weight stack. In this manner, peg portion 15*a* passes through the hole in the selector bar, peg portions 15*a* and 15*c* are moved into the spaces on either side of the selector bar, beneath the second selected weight in the stack, and peg portion 15*b* is disposed within the hole in the selector bar.

As discussed above, selector pin 12*a* is positioned in the selector bar 59 such that, when a first force is exerted on a lever of a weight lifting machine, the selector bar is raised and the first selected weight amount is lifted. As the selector bar is raised, peg portion 15*b* of second selector element 14*c* is also raised, since it is positioned in the hole in the selector bar, while peg portions 15*a* and 15*c* remain in position under the second selected weight amount, such that cable 11 is extended and second selector element 14*c* is configured as in FIG. 7*b*. As the first weight amount is raised further, when cable 11 can be extended no further, an additional force must be exerted on the lever in order for the user to be able to raise the second selected weight amount.

In accordance with an embodiment (not shown), the second selector element may be formed of two peg portions, 15*b* and 15*c*, having a distance limiting element in the form of a flexible cable 11 extending therethrough, wherein peg portion 15*b* is provided with a rotatable adjustment element 16*a* and is provided with a stationary retaining element 18*a*. As in the embodiment shown in FIGS. 7*a* and 7*b*, the portion of cable 11 disposed within peg portions 15*b* and 15*c* may be lengthened as desired, by rotating adjustment element 16*a* in the direction of arrow B.

Figure 8A:
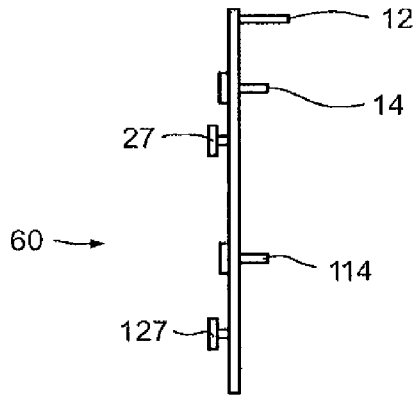
FIGS. 8*a* and 8*b* are front and side views, respectively, of a three-stage weight selector device in accordance with an embodiment of the present invention.
Figure 8B:
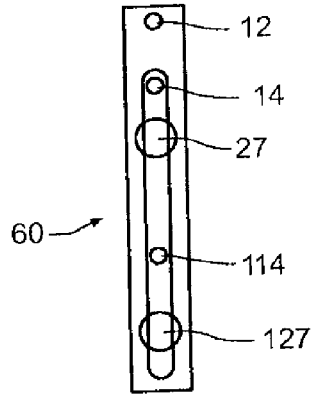

FIGS. 8*a* and 8*b* illustrate a three-stage device 60 in accordance with an embodiment of the present invention wherein, in addition to enabling the selection of first and second weight amounts to be lifted on exertion of first and second forces, respectively, the device enables a user to select a third weight amount to be lifted upon exertion of a third force. Device 60 enables a user to exercise a particular portion of the body in a manner such that three successive selected forces must be exerted over three successive selected distances, thereby facilitating use of a conventional weight lifting machine having a weight stack in a manner that was not previously achievable.

Device 60 is provided with a first selector element 12, a second selector element 14, and a stop element 27 which are identical to those of weight selector device 10 shown in FIGS. 1*a*-4. Device 60 is, however, additionally provided with a third selector element 114 having a stop element 127. The operation and function of third selector element 114 and stop element 127 are identical to those of second selector element 14 and stop element 27, respectively.

The device 60 according to the present embodiment enables a user to select first, second, and third weight amounts to be lifted from a stack of weights of a weight lifting machine, by exerting first, second, and third forces, respectively, on a lever of the weight lifting machine. The device 60 additionally enables the user to select the distance over which the first force must be exerted, in order to raise the first selected weight amount, before the second force must be exerted, in order to raise the second selected weight amount, and to select the distance over which the second force must be exerted, in order to raise the second selected weight amount, before the third force must be exerted, in order to raise the third selected weight amount.

Figure 9:
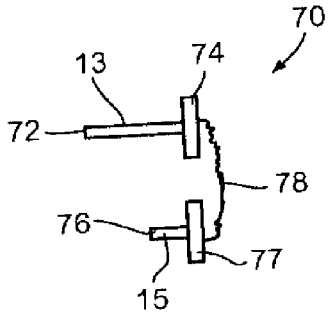
FIG. 9 is a side view of a weight selector device in accordance with an embodiment of the present invention.

FIG. 9 illustrates a weight selector device 70, in accordance with an embodiment of the present invention which enables the selection of first and second weight amounts to be lifted on exertion of first and second forces. Device 70 includes a first selector element 72, including a peg 13 and a fastening element 74, and a second selector element 76, including a peg 15 and a fastening element 77. First selector element 72 and second selector element 76 are attached to each other by means of a flexible distance limiting element 78 such that, when the distance limiting element 78 is extended, the distance between first and second selector elements 72 and 76 is fixed. Distance limiting element 78 may be formed of, for example, a cable or chain. Each of pegs 13 and 15 is preferably cylindrical, thereby facilitating insertion thereof into a space between adjacent weights in a weight stack. Fastening elements 74 and 77 are preferably formed of flat plates such that, when pegs 13 and 15 are inserted into spaces between weights in a weight stack, fastening elements 74 and 77 may be disposed adjacent the weight stack and distance limiting element 78 may be extended, as discussed above, thereby fixing the distance between first and second selector elements 72 and 76. Device 70 according to the present embodiment enables a user to select first and second weight amounts to be lifted from a stack of weights of a weight lifting machine, by exerting first and second forces, respectively, on a lever of the weight lifting machine. As the length of extended distance limiting element 78 is fixed, so is the distance over which the first force must be exerted, in order to raise the first weight amount, before the second force must be exerted, in order to raise the second weight amount.

In accordance with an embodiment of the present invention, distance limiting element 78 may be replaced with an elastic distance limiting element, for example a spring, such that, when the elastic distance limiting element is extended but not yet stretched, the distance between first and second selector elements 72 and 76 is not fixed.

After a first weight amount is raised and the spring begins to stretch, the second weight amount is raised, but not immediately upon the spring being extended. Depending on the elastic properties of the spring chosen, the increase in the amount of force required to raise the second weight amount will be progressive, as the first weight amount is raised further and the spring is stretched. This increase will continue until the spring is maximally stretched. The user is required to increase the force he exerts, as the spring is stretched and he feels an increase in the amount of the second weight being raised. This progressive effect will continue until the entire amount of the second weight selected is raised.

Preferably, in order to avoid damage to the spring, such as tearing, the spring will be able to withstand a force at least as great as that required to raise the entire stack of weights. If desired, there may be provided a cable (not shown) inside the spring in order to prevent over-extension of the spring.

This effect, whereby the amount of the second selected weight is increased progressively, may additionally be achieved using an embodiment similar to that shown in FIGS. 7*a-c*, wherein flexible cable 11 is replaced by a flexible and stretchable cable.

Figure 10:
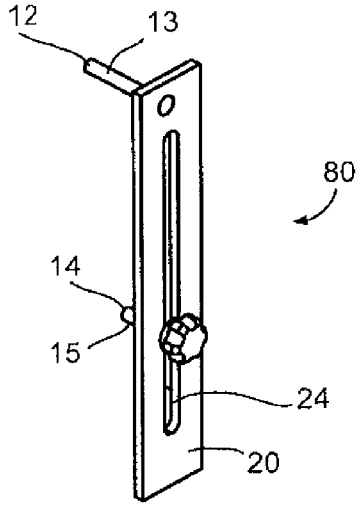
FIG. 10 is a perspective view of a weight selector device in accordance with an embodiment of the present invention.

FIG. 10 illustrates a weight selector device 80, in accordance with an embodiment of the present invention. Device 80 includes a first selector element 12, including a cylindrical peg 13; a second selector element 14, including a cylindrical peg 15; and a distance limiting element 20 which are similar in configuration to the identical elements of device 10 (FIG. 1*a*). Device 80 differs, however, from device 10 in that device 80 does not include a stop element 27. While first selector element 12 and second selector element 14 in device 80 function in a manner similar to that in device 10, the movement of second selector element 14 along slot 24 is limited by the length of a slot 24 in distance limiting element 20.

Weight selector device 80 enables a user to select first and second weight amounts to be lifted from a stack of weights of a weight lifting machine, by exerting first and second forces, respectively, on a lever of the weight lifting machine, in a manner similar to that discussed above with regard to device 10. As noted above with regard to device 10, device 80 according to the present embodiment enables a user to exert a first force on a lever of the weight lifting machine, thereby lifting a first selected number of weights a particular distance and then, if a second force is exerted on the lever in the same direction as the first force, the user is able to raise a second selected weight amount from the weight stack. When employing device 80, the distance through which the first selected weight amount must be lifted by the first force, before the second force must be exerted in order to lift the second selected weight amount, is determined by the length of slot 24.

If desired, there may be provided a series of weight selector devices 80, each having identical elements except for the length of slot 24, such that a user may select one device from the series, the selected device having a slot of a particular length. In this manner, a user may select a distance through which a first selected weight amount must be lifted by a first force, before a second force must be exerted in order to lift a second selected weight amount. Once a device 80 having a slot of a particular length has been selected, the user would then be able to select first and second weight amounts to be lifted from a stack of weights of a weight lifting machine, in a manner similar to that described above, with reference to device 10.

It may be noted that the various embodiments of the device of the present invention have been shown and described above as being suitable for use with a weight lifting machine wherein a selector element is insertable in a space formed along the longer side of the weights, facing the user. The present embodiment is also, however, suitable for use with a weight lifting machine wherein spaces between adjacent weights are formed along the shorter side of the weights.

It is expected that during the life of a patent maturing from this application many relevant weight lifting machines will be developed and the scope of the terms selector element, selector bar, and weight stack is intended to include all such new technologies a priori.

The terms "comprises," "comprising," "includes," "including," "having," and their conjugates mean "including but not limited to." This term encompasses the terms "consisting of" and "consisting essentially of."

As used herein, the singular form "a," "an," and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicated number and a second indicated number and "ranging/ranges from" a first indicated number "to" a second indicated number lo are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents, and patent applications mentioned in this specification are herein incorporated in their entirety by reference into the specification, to the same extent as if each individual publication, patent, or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A weight machine selector device for use with a weight lifting machine having a single stack with a plurality of weights to be lifted and an exertion element configured to exert force so as to lift a preselected amount of weight from the single stack comprising:

a first selector element configured to mechanically select a first amount of weight to be lifted from the single stack;

a second selector element configured to mechanically select a second amount of weight to be lifted from the single stack, said second selector element being movable relative to said first selector element;

whereby said device is configured such that the exertion element exerts a force so as to lift the second amount of weight only subsequent to lifting the first amount of weight; and a distance limiting element configured to limit the distance between said first selector element and said second selector element, said distance limiting element having an adjustable portion configured to limit the distance between said first selector element and said second selector element to a selected distance, wherein said distance limiting element is flexible and at least a portion of said distance limiting element is disposed within said second selector element.

2. A device according to claim 1, further comprising markings on said distance limiting element for facilitating positioning of said second selector element.

3. A device according to claim 1, wherein said second selector element is movable relative to said first selector element by lengthening or shortening of said distance limiting element.

4. A device according to claim 1, wherein said distance limiting element is configured to be lengthened or shortened by turning of said second selector element.

5. A device according to claim 1, wherein said distance limiting element is elastic.

6. A device according to claim 1, wherein said first selector element is configured to select a first number of weights to be lifted from the stack, and said second selector element is configured to select a second number of weights to be lifted from the stack.

7. A series of weight machine selector devices according to claim 1, wherein each of said selector devices has a corresponding distance limiting element, and wherein each adjustable portion of each distance limiting element is adjusted such that all of the distance limiting elements are of a particular length.

* * * * *